US012378836B2

(12) United States Patent
Maclver et al.

(10) Patent No.: US 12,378,836 B2
(45) **Date of Patent: *Aug. 5, 2025**

(54) METHOD AND SYSTEM FOR DEPLOYING AN ELECTRIC SUBMERSIBLE PUMP IN A LIVE WELL

(71) Applicant: Schlumberger Technology Corporation, Sugar Land, TX (US)

(72) Inventors: Ivor Maclver, Aberdeenshire (GB); Norman Liley, Aberdeen (GB); Iain Maclean, Aberdeen (GB); Calum Crawford, Aberdeenshire (GB); Steven Browning, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 226 days.

This patent is subject to a terminal disclaimer.

(21) Appl. No.: 18/092,470

(22) Filed: Jan. 3, 2023

(65) Prior Publication Data

US 2023/0203910 A1 Jun. 29, 2023

Related U.S. Application Data

(63) Continuation of application No. PCT/EP2021/068255, filed on Jul. 1, 2021.

(Continued)

(51) Int. Cl.
*E21B 33/04* (2006.01)
*E21B 33/03* (2006.01)

(Continued)

(52) U.S. Cl.
CPC ..... *E21B 33/0407* (2013.01); *E21B 33/03* (2013.01); *E21B 33/0385* (2013.01);

(Continued)

(58) Field of Classification Search
CPC .. E21B 33/0407; E21B 33/03; E21B 33/0385; E21B 33/04; E21B 33/072; E21B 43/128
See application file for complete search history.

(56) References Cited

U.S. PATENT DOCUMENTS 3,638,732 A * 2/1972 Huntsinger ..... E21B 17/023 166/368
4,589,492 A * 5/1986 Greiner ..... E21B 33/0385 439/194

(Continued)

OTHER PUBLICATIONS

Search Report and Written Opinion of International Patent Application No. PCT/EP2021/068255 dated Oct. 21, 2021, 9 pages.

(Continued)

*Primary Examiner* — Tara Schimpf
*Assistant Examiner* — Neel Girish Patel
(74) *Attorney, Agent, or Firm* — Jeffrey D. Frantz

(57) ABSTRACT

A method for installing an electric submersible pump (ESP) in a well includes installing a plug in the well below a well tree. An upper and lower master valve on the tree are closed. Closure elements are removed from the lower master valve and replaced with gate seats, and a replacement gate block. The replacement gate block has a seat for a cable hanger. The upper master valve is opened. The plug is removed and the ESP extended into the well on an electrical cable. A cable hanger is affixed to the cable and is seated in the seat. The cable hanger has sealing elements to engage the seat and an electrical connector. The electrical connector is oriented to enable access through a side opening in the replacement gate block.

9 Claims, 17 Drawing Sheets

Related U.S. Application Data

(60) Provisional application No. 63/047,940, filed on Jul. 3, 2020.

(51) Int. Cl.
*E21B 33/038* (2006.01)
*E21B 33/072* (2006.01)
*E21B 43/12* (2006.01)

(52) U.S. Cl.
CPC ..... *E21B 33/04* (2013.01); *E21B 33/072* (2013.01); *E21B 43/128* (2013.01)

(56) References Cited

U.S. PATENT DOCUMENTS 4,804,045 A * 2/1989 Reed ..... E21B 33/0407 166/313
5,236,037 A * 8/1993 Watkins ..... E21B 33/04 285/123.3
6,394,837 B1 * 5/2002 Edwards ..... H01R 13/523 439/426
7,410,002 B2 * 8/2008 Khazanovich ..... E21B 33/0385 166/382
10,036,210 B2 7/2018 Maclean
10,774,608 B2 * 9/2020 June ..... E21B 33/03
10,900,315 B2 * 1/2021 Xiao ..... E21B 33/04
11,965,390 B2 * 4/2024 Maciver ..... E21B 43/128
12,173,562 B2 * 12/2024 Marbach ..... E21B 17/028
2010/0170679 A1 * 7/2010 Borak, Jr. ..... E21B 33/04 166/75.13
2011/0036596 A1 * 2/2011 Nguyen ..... E21B 33/12 166/386
2011/0300008 A1 * 12/2011 Fielder ..... E21B 33/0353 166/368
2015/0068769 A1 * 3/2015 Xiao ..... E21B 43/12 166/382
2015/0260010 A1 * 9/2015 Lugtmeier ..... E21B 33/03 166/97.1
2017/0044865 A1 * 2/2017 Sabins ..... E21B 43/116
2018/0223619 A1 * 8/2018 June ..... E21B 33/0353
2023/0295998 A1 * 9/2023 Hoines ..... E21B 29/04 166/373

OTHER PUBLICATIONS

International Preliminary Report on Patentability of International Patent Application No. PCT/EP2021/068255 dated Jan. 13, 2023, 6 pages.
International Search Report and Written Opinion, International Application No. PCT/EP2021/068255 issued Oct. 21, 2021.

* cited by examiner

METHOD AND SYSTEM FOR DEPLOYING AN ELECTRIC SUBMERSIBLE PUMP IN A LIVE WELL

CROSS REFERENCE TO RELATED APPLICATIONS

Continuation of International Application No. PCT/EP2021/068255 filed on Jul. 1, 2021. Priority is claimed from U.S. Provisional Application No. 63/047,940 filed on Jul. 3, 2020. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of submersible well pumps, in particular electric submersible pumps (ESPs). More particularly, the present disclosure relates to methods for deploying ESPs through well tubing, e.g., on electrical cable, without the need to "kill" a well that has produced fluid from the subsurface or is fully prepared for such production.

Well pumps such as sucker rod pumps and ESPs are used on subsurface fluid producing wells when natural pressure in a subsurface reservoir formation is insufficient to lift useful fluids, e.g., oil and gas, to surface. Such insufficient pressure may be the result of depletion of natural pressure as fluid is produced, insufficient original pressure in the reservoir or hydrostatic loading in the relevant well caused by water being produced from the reservoir into the well so as to counteract the reservoir pressure.

In cases where a well has been producing fluid and later deployment of a pump is required, or in cases where a well already has a pump, but the pump has failed, or even in cases where a well is fully prepared for production prior to installing a pump, using methods known in the art to deploy a pump on such a "live" well typically requires "killing" the well, thus making it unable to move fluid to surface even inadvertently. Killing a live well may be performed, e.g., by displacing fluid in the well with high density "kill" fluid to exert enough hydrostatic pressure such that reservoir pressure is essentially unable to move fluid to surface. Killing a well can be difficult and expensive, and requires transport to the well of pumping equipment, storage for the kill fluid and associated pressure control equipment. The high density "kill" fluid can also cause a reduction in permeability of the reservoir formation in the near-wellbore area, such as may result from the displacement of debris that plugs openings in a well casing or liner ("perforations") or induced changes in the formation mineral grain structure ("matrix"). Such actions may reduce the productivity of the well. Killing a well is therefore undesirable.

U.S. Pat. No. 10,036,210 issued to Maclean et al. discloses a method for deploying an ESP through the production tubing on a tubing encapsulated electrical cable. The deployment cable is also used to provide power to the ESP and to communicate control signals from surface to the ESP and any data signals from the ESP to surface. Therefore, the tubing encapsulated cable may remain in the well after the initial ESP deployment. The method disclosed in the '210 patent may enable retrofit of an ESP in a well that has a failed pump deployed on the production tubing, but the disclosed method may still require killing the well for such deployment depending on how the cable exits the well at the surface, i.e., in the wellhead area.

Other methods for installation, maintenance and repair of cable deployed through-tubing well pumps may require removing a surface control and safety valve assembly ("tree"). Moving the tree incurs substantial cost by reason of the need to provide suitable lifting equipment, and disconnection of produced fluid lines (flow lines) from the tree and subsequent replacement and reconnection of the tree and possible adjustment of the flowlines connected to the tree.

It is desirable to have a method for installing an ESP in a well without the need to kill it and without the need to disconnect the tree from the well or adjusting the flowlines.

SUMMARY

One aspect of the present disclosure is a method for installing an electric submersible pump (ESP) in a well. A method according to this aspect includes installing at least one plug in the well below a well tree. An upper master valve and a lower master valve in the well tree are closed. Valve closure elements are removed from the lower master valve and the closure elements are replaced with gate seats, and a replacement gate block. The replacement gate block comprises a seat for a cable hanger. The upper master valve is opened. The at least one plug is removed. The ESP is extended into the well on the end of an electrical cable. A cable hanger is affixed to the electrical cable and the cable hanger is seated in the seat. The cable hanger has sealing elements to engage the seat and an electrical connector. The electrical connector is oriented to enable access through a horizontal bore in the replacement gate block.

The sealing elements on the cable hanger may close the side opening to fluid flow when the cable hanger is disposed in the seat.

The installing the one or more plugs, extending the ESP into the well and the affixing the cable hanger may be performed by affixing a blowout preventer and lubricator to the well tree after closing the upper master valve.

Some examples may further comprise inserting a packer into the well after removing the plug and prior to extending the ESP.

The electrical cable may comprise a tubing encapsulated cable.

Some examples may further comprise making electrical connection to the electrical connector and operating the ESP.

Some examples may further comprise affixing at least one of a plug and a back pressure valve in a profile in an upper one of the gate seats, the upper one of the gate seats disposed in a through bore in the master valve.

Some examples may further comprise causing an orienting tool coupled to one end of the cable hanger to contact an orienting screw disposed in the horizontal bore, the orienting tool comprising at least one helically shaped orienting tulip to urge the cable hanger into a predetermined rotational orientation.

The orienting screw may extend into a through bore in the replacement gate block.

A pump installation system for a well includes a replacement gate block adapted to be disposed in a body of a master valve on a well tree. The replacement gate block has a seat for a cable hanger and a horizontal bore for an electrical connector. The replacement gate block has at least one bypass port adjacent the seat to enable fluid movement past the seat longitudinally. The horizontal bore is closed to fluid movement when a cable hanger is disposed in the seat. Gate seats are insertable into a through bore in the master valve body to sealing engage the replacement gate block. A cable hanger is attachable to an electrical cable. The cable hanger has slips to transfer axial loading from the electrical cable to the cable hanger. The cable hanger has electrical contacts to enable access through a side of the cable hanger. The cable has seals to close the horizontal bore to fluid movement when the cable hanger is disposed in the seat.

The replacement gate block, the gate seats and a side seal disposed between the replacement gate block and a bonnet on the master valve body may comprise fluid ports engageable with existing pressure test and relief ports in the master valve body to enable pressure testing and pressure relief of seal element in the replacement gate block, the gate seats and the side seal.

Some examples may further comprise an electrical connector disposable through the horizontal bore to engage an electrical connector on a side of the cable hanger.

The electrical connector on the cable hanger may comprise a plug to sealingly close a port prior to engagement of the electrical connector disposable through the horizontal bore.

Some examples may further comprise a blanking plug disposable in the horizontal bore to close the horizontal bore to fluid flow prior to insertion of the cable hanger into the seat.

Some examples may further comprise at least one of a plug and a back pressure valve disposed in a profile in an upper one of the gate seats, the upper one of the gate seats disposed in a through bore in the master valve.

Some examples may further comprise an orienting tool coupled to one end of the cable hanger, the orienting tool comprising at least one helically shaped orienting tulip.

Some examples may further comprise an orienting screw disposed within the valve body an extending into the through bore on a side of the valve closure element opposed to the seal area, the orienting screw extending into the through bore to engage the at least one orienting tulip.

Other aspects and possible advantages will be apparent from the description and claims that follow.

DETAILED DESCRIPTION

Figure 1A:
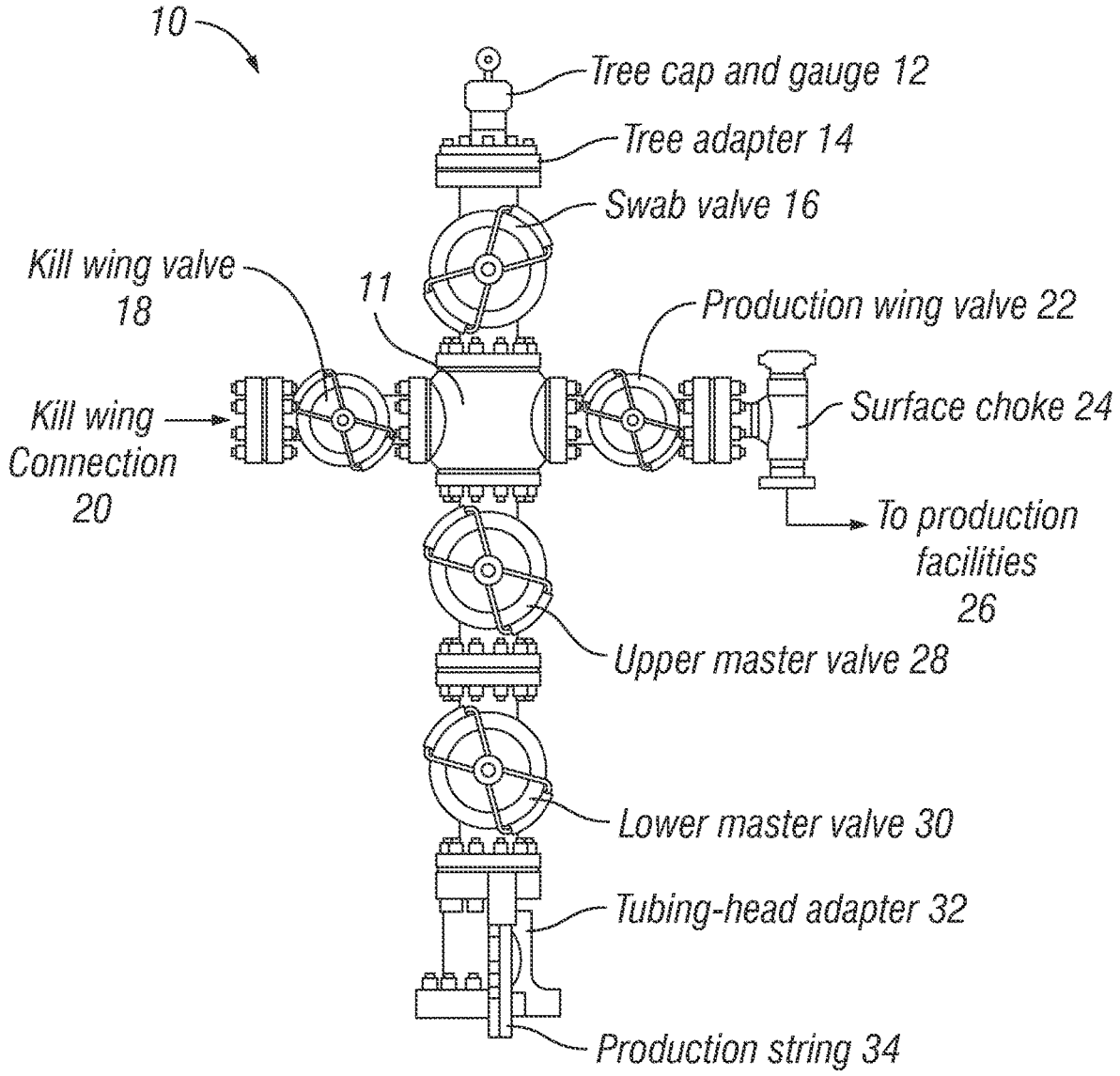
FIG. 1A shows a flanged type well control valve assembly ("tree") having master valves, the tree being usable in methods according to the present disclosure.

FIG. 1A shows a well surface control valve assembly ("tree") 10 that may be used in accordance with methods according to the present disclosure. The tree 10 shown in FIG. 1 is a "flanged" tree that may be assembled from flange-coupled individual components, for example, a tree cap and pressure gauge 12 at an uppermost end of the tree 10, beneath which may be flange coupled, in downward order of their illustration vertically, a tree adapter 14, a swab valve 16, an adapter 11, an upper master valve 28, a lower master valve 30, a tubing head adapter 32 and the upper end of a production tubing string 34 (located internally to the tubing head adapter 32). The adapter 11 may have, on respective side ports, a kill wing valve 18 and associated kill line connection 20, and a production wing valve 22 and associated connection to a choke 24 and a connector to a flow line 26. Methods according to the present disclosure may begin by closing the master valves 28, 30, the wing valves 18, 22 and removing the tree adapter 14, and cap and pressure gauge 12 from the tree 10.

Figure 1B:
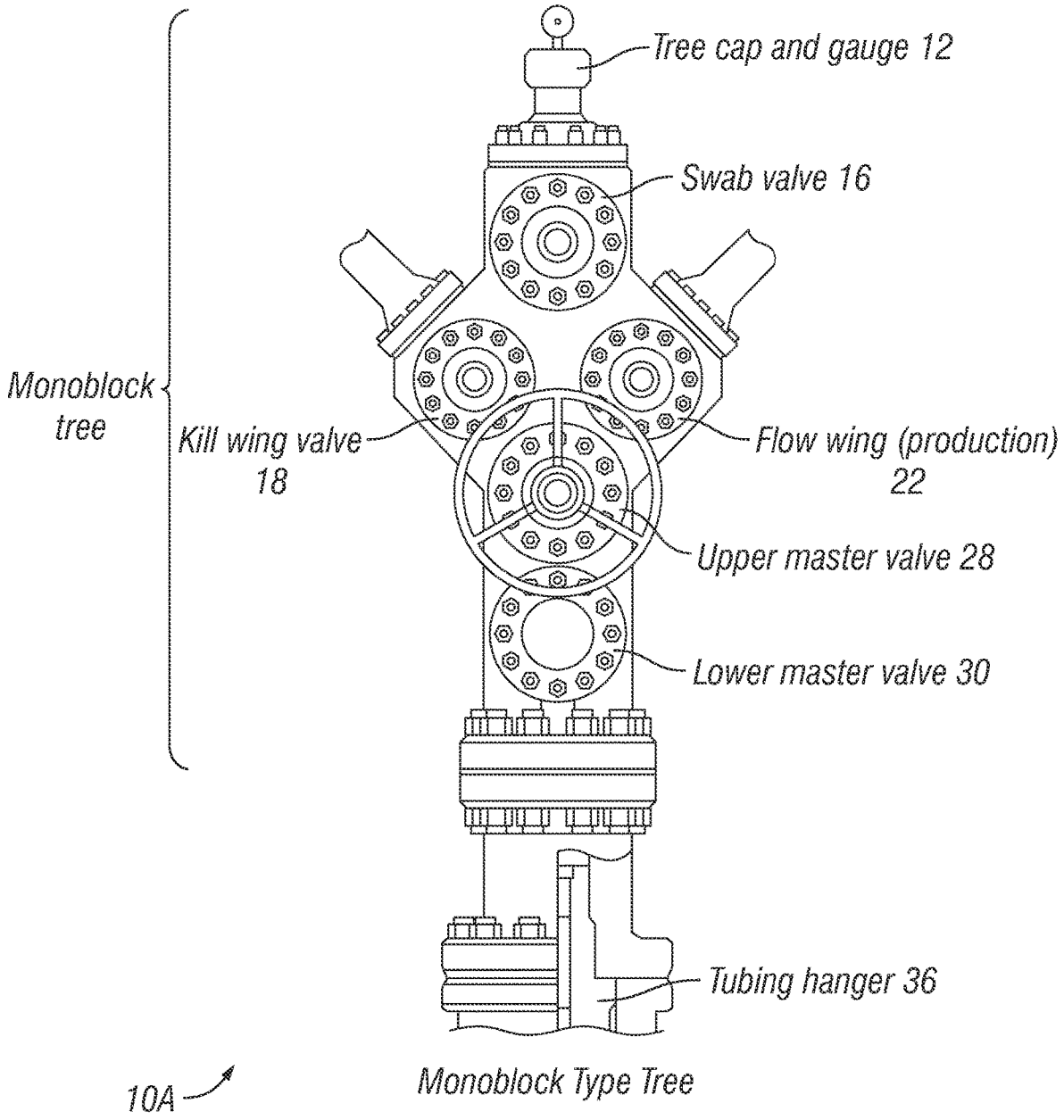
FIG. 1B shows a monoblock tree having master valves, the tree being usable in methods according to the present disclosure.

FIG. 1B shows another tree 10A that may be used in accordance with methods disclosed herein. The tree 10A in FIG. 1B is known as a monoblock tree and may have some or all of the same components as the tree shown in FIG. 1A, with differences being that the master valves 28, 30 and wing valves 18, 22 may be disposed in a single, forged component to be affixed to the top of the well casing or liner. A tubing hanger 36 is shown in FIG. 1B for clarity of the illustration, from which a production tubing (not shown) may extend into the well (not shown) below the tree 10B. For purposes of the present disclosure, the type of tree is not a limitation on the scope; any type of tree with two (or more) master valves may be used in accordance with presently disclosed methods.

For purposes of describing methods according to the present disclosure, the well may be "completed", that is, casing or liner may be extended through an intended fluid producing reservoir formation; production tubing is installed in the casing or liner to a selected depth in the well; and the well otherwise is fully capable of producing fluid from an hydraulically connected subsurface reservoir, e.g., by perforating the casing or liner below the production tubing (see FIG. 2). A pump (not shown) may already be installed in such a well, e.g., at the base of the production tubing, or a naturally flowing well may have decreased fluid production for reasons explained in the Background section herein such that installation of an ESP is indicated.

Figure 2:
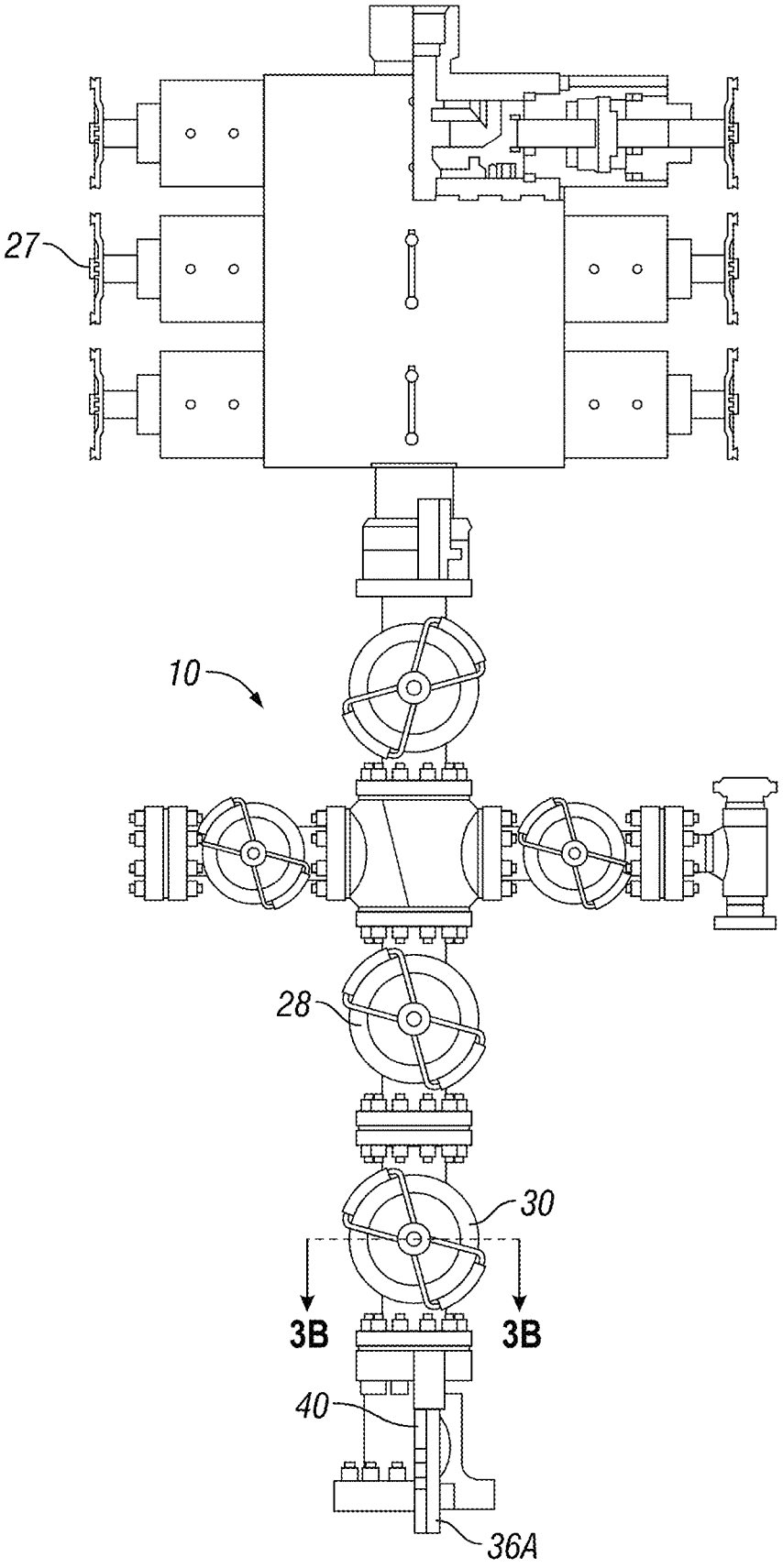
FIG. 2 shows inserting a plug or valve into an upper end of a production tubing to temporarily close the well below the tree.

At the beginning of an example method according to this disclosure and referring to FIG. 2, the master valves 28, 30 may be closed and the tree adapter (14 in FIG. 1) and tree cap and gauge 12 may be removed. A pressure control assembly or "blowout preventer" 27 may be coupled to the open top of the tree 10, e.g., an upper flange exposed by removing the tree cap and gauge 12. The blowout preventer ("BOP") 27 may comprise one or more sets of sealing elements called "rams", intended to close the well completely, close around a specific device extended through the BOP 27 such as pipe or a cable and to shear any such device passing through the BOP 27 in an emergency. A tube (shown at 82 in FIG. 2A), called a lubricator, may be coupled to the upper end of the BOP 27, e.g., by a flange connection or a threaded connection, to enable fluidly enclosing components such as an ESP (86, 88 in FIG. 2A) above the tree 10 before reopening the master valves 28, 30, while maintaining the well fully closed to the external atmosphere. A well plug 40 in the form of a backpressure valve or other type of plug may be attached to a cable head (84 in FIG. 2A) at the end of a wireline, slickline or cable (hereinafter "cable" for convenience), or a special valve setting tool, and inserted into the open end of the lubricator (82 in FIG. 2A). The lubricator (82 in FIG. 2A) may be reconnected to the BOP 27, the master valves 28, 30 reopened, and then the plug 40 is moved through the tree 10 and is locked in place as shown in FIG. 2 to seal the well below.

Figure 2A:
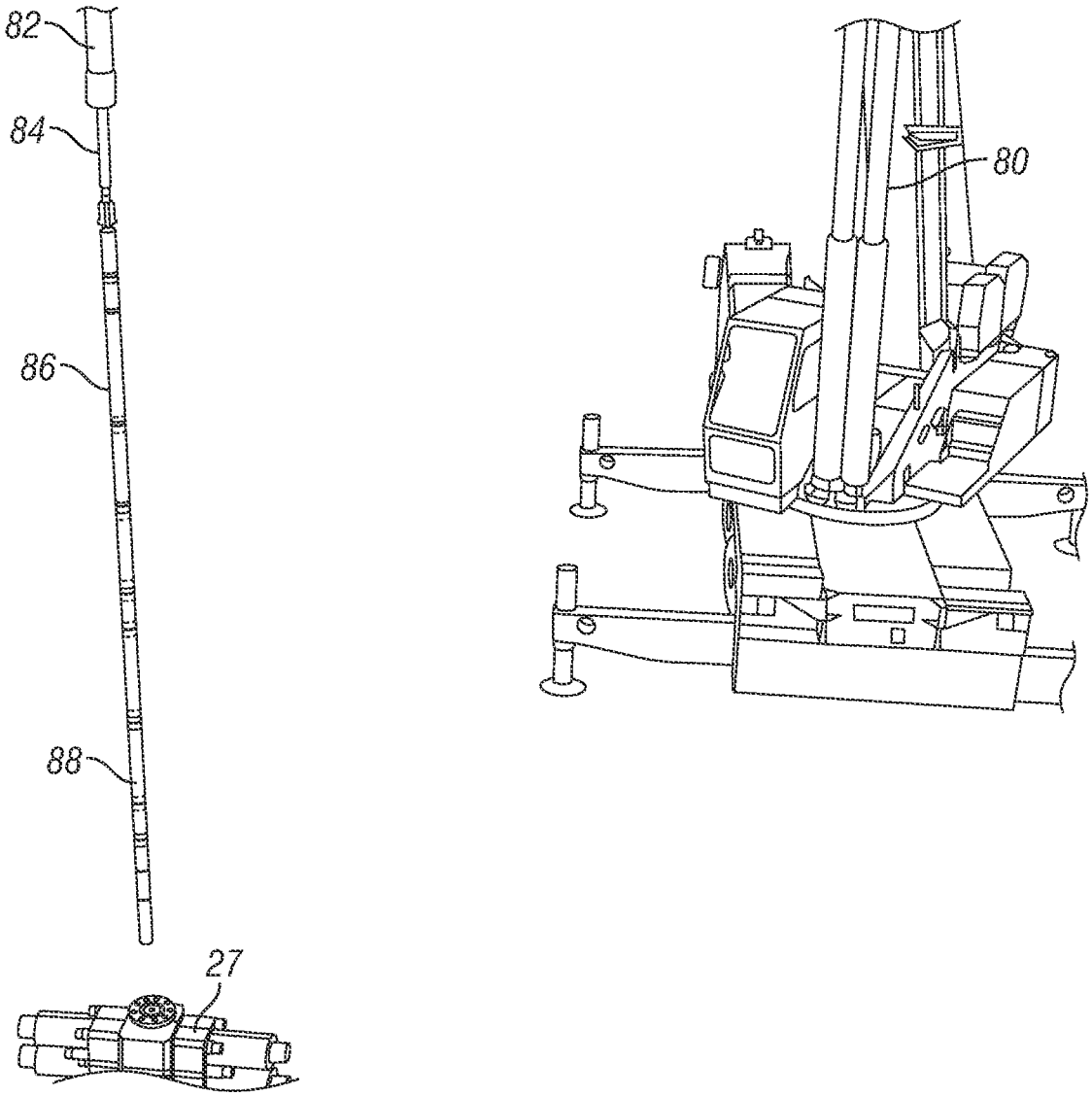
FIG. 2A shows a crane or hoist suspending a lubricator over the BOP with a cable head, pump motor and protector and pump suspended within the lubricator.

Referring to FIG. 2A, the lubricator 82 may be suspended by a crane 80 or other suitable hoisting apparatus. The ESP, comprising a motor section and protector 86 and a pump section 88 may be connected to the cable by a cable head 84. The cable may be spooled from a winch (not shown) in any manner known in the art.

Figure 3B:
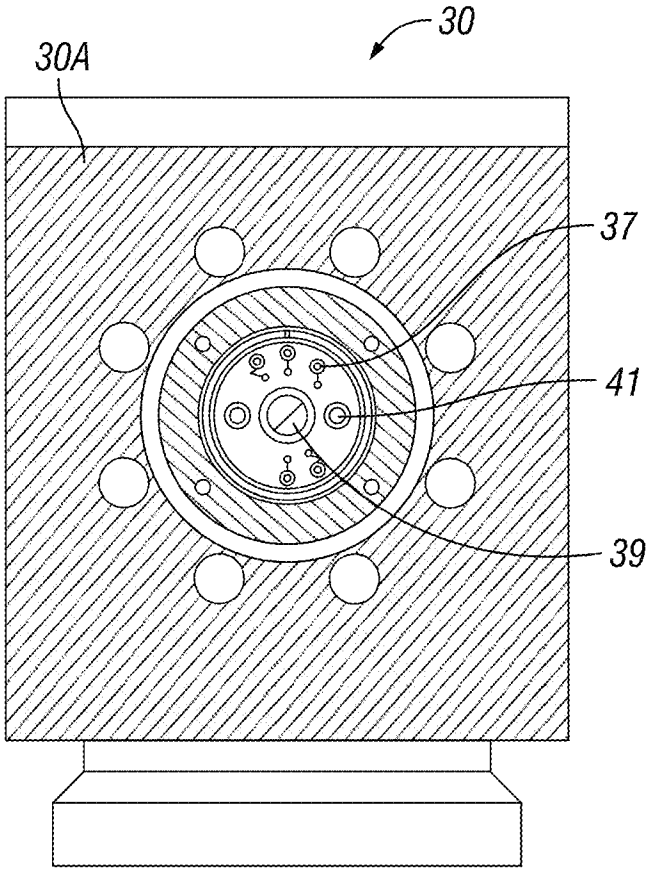
FIGS. 3A and 3B show cross sections of one of the master valves on the tree (either FIG. 1 or FIG. 2) wherein internal components of the master valve have been replaced by a hanger landing and seal assembly for installing an ESP.
Figure 3A:
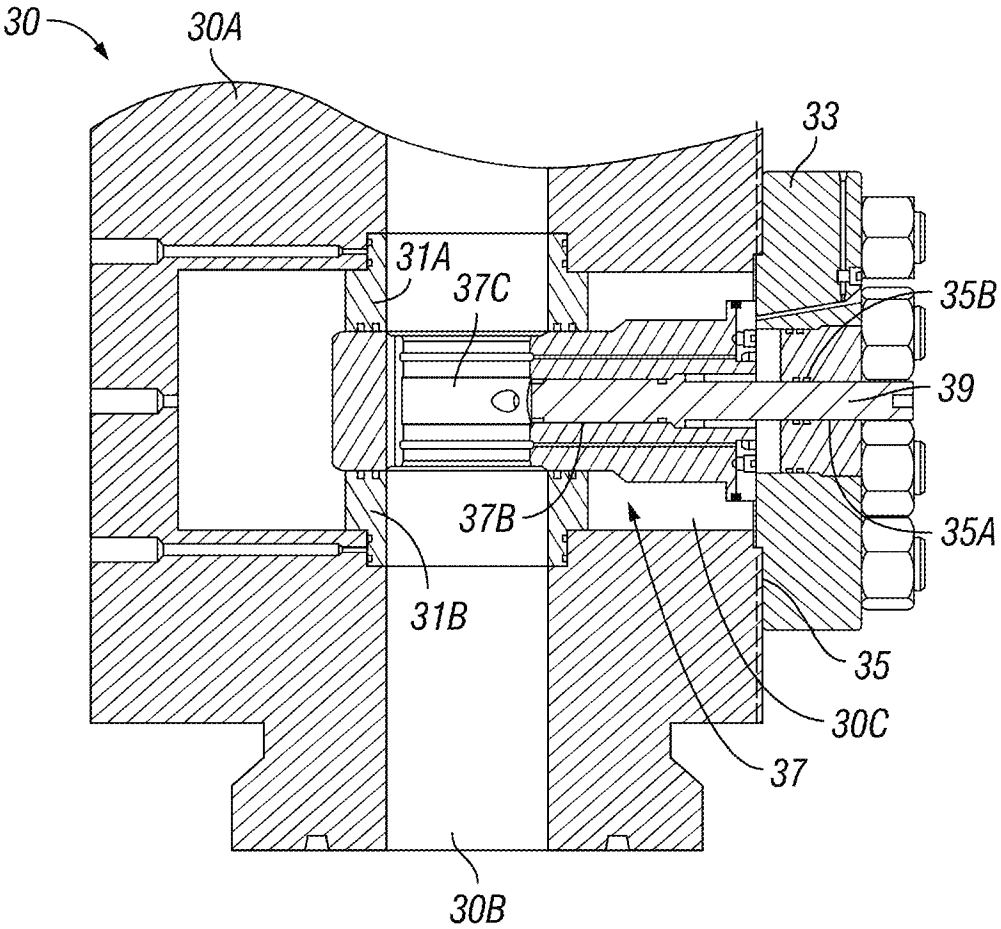

Once the plug 40 is set in the production tubing 36A, and referring to FIGS. 3A and 3B, after the plug 40 is pressure tested, for example, by pumping fluid into one of the wing valves (e.g., 20 in FIG. 1A), the lower master valve 30 may be disassembled and retrofit with components to enable carrying out a method according to the present disclosure. The well remains closed to the external atmosphere by reason of the plug 40 being set in the tubing 36A. The lower master valve 30 may be, for example, a gate valve, wherein valve closure elements disposed in a valve body 30A may comprise: a gate slidingly inserted into and withdrawn between two gate seats disposed in a through bore 30B of the valve body 30A; a bonnet 33, which retains the gate and a gate stem in the valve body 30A. A bonnet 33 may be unbolted from the valve body 30A to enable removing (none shown in the figures for clarity) the gate and a gate stem; a thread block; and the gate seats. Once the foregoing components are removed from the valve body 30A, replacement gate seats 31A, 31B may be inserted and placed in the valve body 30A in the through bore 30B by insertion through a side bore 30C. The side bore 30C already is formed in the valve body 30A and is vacated by removing the original gate and the associated components explained above from the valve body 30A. A replacement gate block 37 comprising (not shown in FIGS. 3A and 3B, explained further below) upper and lower hanger seal profiles, upper and lower gate seal profiles, and horizontal penetrator seal profiles (with all seals located in mating parts) may be inserted into the side bore 30C to sealingly engage the gate seats 31A, 31B in the valve body 30A. A horizontal blanking plug 39 may be disposed in a horizontal bore 37B formed in the replacement gate block 37. The horizontal bore 37B provides location for a horizontal penetrator, to be explained further below. The bonnet 33 may then be reassembled to the valve body 30A and sealed using, e.g., a conventional ring gasket 35. The horizontal blanking plug 39 sealingly closes a bore 35A through the bonnet 33, using suitable seals 35B. The replacement gate block 37 may comprise bores 41 to enable insertion of lockdown screws (see FIG. 5B) to hold a cable hanger (see FIG. 4A) in place in the replacement gate block 37. The lockdown screw bores 41 may be disposed in the replacement gate block 37 so that well pressure is not communicated to the bores 41 when a cable hanger (more detail below) is seated in the replacement gate block 37.

When the replacement gate block 37 and blanking plug 39 are in place as shown in FIGS. 3A and 3B, and the bonnet 33 is reinstalled, the lower master valve body 10A is then pressure sealed such that the side bore 30C is closed to fluid flow. With the side bore 30C of the valve body 30A thus closed to fluid flow, the plug (40 in FIG. 2) may be removed from the well tubing, using, e.g., wireline or cable extended through the lubricator (FIG. 2A) and BOP (see 27 in FIG. 2) to enable access to the well below the tree (10 in FIG. 2). Then the upper master valve (28 in FIG. 1 or FIG. 1A) may be closed to enable uncoupling the lubricator (82 in FIG. 2A) for further intervention into the well below the tree (10 in FIG. 2) while keeping the well fluidly closed.

The replacement gate block 37 may be shaped such that all the test and bleed ports in the master valve body 30A may be used to test pressure integrity of the replacement gate block 37 and all the associated components described herein.

With the plug (40 in FIG. 2) removed, and the tree having the lower master valve components replaced as described, some embodiments of a method according to the present disclosure may continue with an annular seal, e.g., a packer (not shown) for the ESP (FIG. 2A) being run into the well to the intended pump setting depth, e.g., by cable, wireline or slickline. The packer (not shown) may be assembled to and run with the ESP (FIG. 2A) in a single operation; for purposes of the present disclosure any similar arrangements may be used. The cable is ordinarily extended through a cable packing in the upper end of the lubricator (82 in FIG. 2A). The packer may be coupled to the cable head (84 in FIG. 2A) and the lubricator (82 in FIG. 2A) may then be reconnected to the BOP (27 in FIG. 2). The upper master valve (28 in FIG. 2) may then then opened, and the packer (not shown) may then be run to the intended depth and set by extending the cable. The cable may then be withdrawn from the well. The upper master valve (28 in FIG. 2) may be closed once again after the cable is withdrawn into the lubricator (82 in FIG. 2A) and the lubricator (82 in FIG. 2A) may then be uncoupled from the BOP (27 in FIG. 2).

The ESP (86, 88 in FIG. 2A) and a deployment cable (see 60 in FIG. 4A), which may be the same cable used to perform the previous operations or a different cable, attached to the ESP (FIG. 2A) are inserted into the lubricator. The lubricator is then reconnected to the BOP (27 in FIG. 2) and the upper master valve (28 in FIG. 2) is once again opened. Rather than closing and reopening the upper master valve (28 in FIG. 2), it is also possible to use blind rams in the BOP (27 in FIG. 2) during the time the lubricator is removed from the BOP (27 in FIG. 2) to fluidly close the well. The ESP (FIG. 2A) may then be extended into the well to its intended setting depth, and may be set in the packer. Deployment of an ESP on cable may in some embodiments be performed using a method such as disclosed in U.S. Pat. No. 10,036,210 issued to Maclean et al. The cable may be a tubing encapsulated cable (TEC) comprising at least one insulated electrical conducted enclosed in a flexible tube, the tube may be deployable from a winch or spool as other forms of electrical cable.

After the ESP (FIG. 2A) is landed in the packer, the deployment cable may then be withdrawn from the well by a calculated space out distance to enable attachment of a cable hanger at a suitable position along the deployment cable. The foregoing act may be omitted in embodiments wherein the packer is assembled to and run with the ESP. Clamp off may be performed, for example by closing cable rams in the BOP (27 in FIG. 2), lifting the lubricator from the BOP (27 in FIG. 2) and affixing a clamp to the deployment cable just above the BOP (27 in FIG. 2). The deployment cable may then be further unspooled from a winch or reel to enable cutting the deployment cable and affixing the cable hanger to the well end of the cut deployment cable.

Figure 4A:
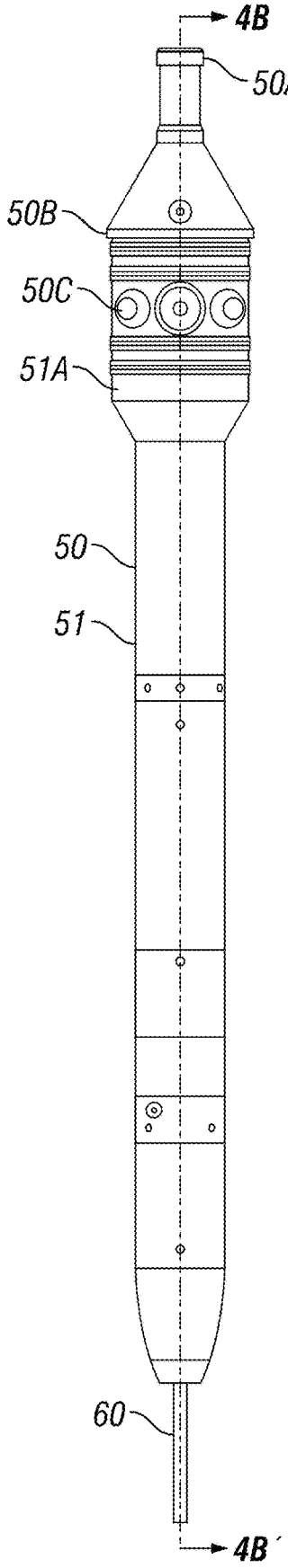
FIGS. 4A and 4B show a side view and cross-section, respectively of a cable hanger, vertical penetrator and horizontal blanking plug for installing an ESP in the well on an electrical cable and suspending the cable in the components shown in FIGS. 3A and 3B.
Figure 4B:
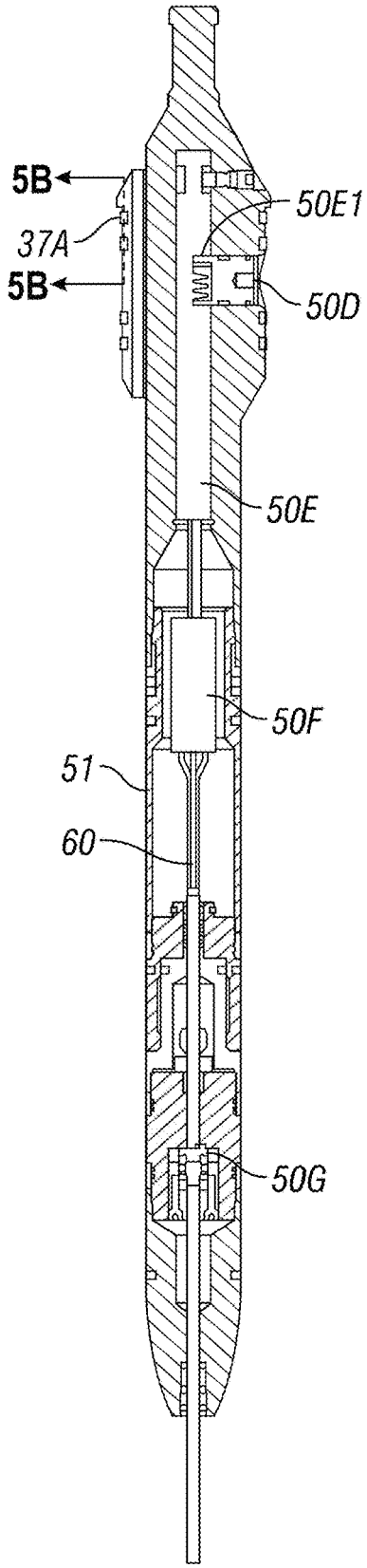

Referring to FIGS. 4A and 4B, the cable hanger 50 will be explained in more detail. The cable hanger 50 may comprise a generally cylindrical hanger housing 51. An outer diameter of the hanger housing 51 may enable passage of most of the cable hanger 50 through a bore (see 37C in FIG. 3A) in the replacement gate block (37 in FIG. 3A). An enlarged diameter section 51A of the hanger housing 51 may have seals 37A disposed thereon at longitudinally spaced apart locations to sealingly engage the bore (37C in FIG. 3A) on opposed sides of the side bore (37B in FIG. 3A) to close the side bore (37B in FIG. 3A) to fluid flow when the hanger housing 51 is seated in the replacement gate block (37 in FIG. 3A). A landing no-go 50B may be provided to limit movement of the hanger housing 51 longitudinally beyond a certain point through the replacement gate (37 in FIG. 3A). The larger diameter section 51A may comprise a lockdown profile 50C for eventual placement of lockdown screws (see FIG. 5B). Cable slips 50G may be disposed in the lower part of the hanger housing 51 to transfer axial loading on the deployment cable 60 to the hanger housing 51. A splice area 50F may provide a pressure sealed chamber in which electrical conductors in the deployment cable 60 may be connected to electrical contacts in a vertical penetrator 50E. The vertical penetrator 50E may be sealingly engaged to an internal bore in the hanger housing 51 such that pressure in the well below the larger diameter section 51A is sealed against release through the side bore (37B in FIG. 3A). Hanger seals are shown at 37A for engagement with the through bore (37C in FIG. 3A). Electrical contacts 50E1 may be provided in the vertical penetrator 50E for connection to corresponding contacts in a horizontal penetrator (see FIG. 7). During this part of the installation procedure, the electrical contacts 50E1 may be sealingly covered by a blanking plug 50D. The cable hanger 50 may comprise a fishing neck 50A at its upper end to enable connection to a running tool (not shown).

Figure 5A:
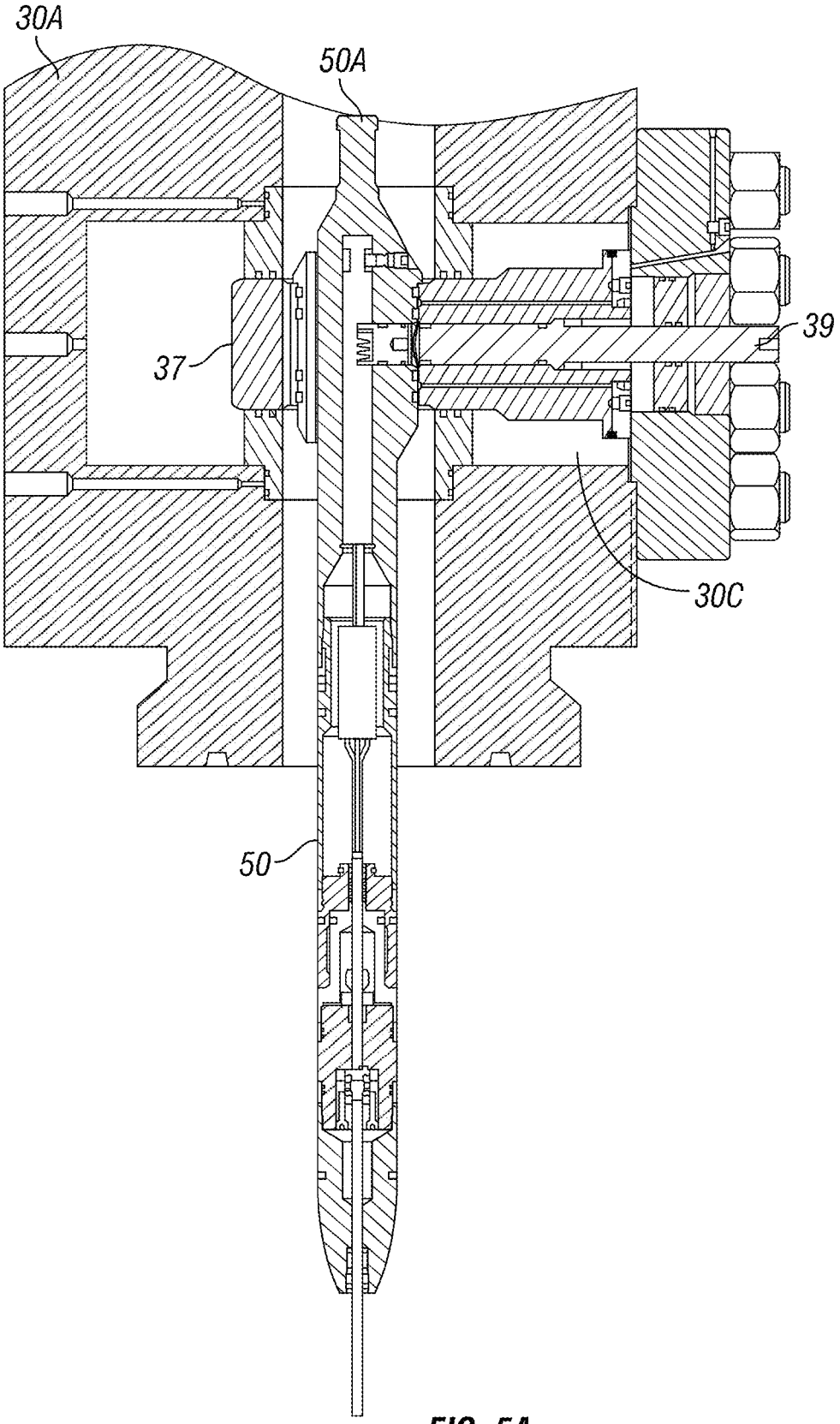
FIGS. 5A and 5B, show, respectively, side cross section view and top cross section view of the master valve shown in FIGS. 4A and 4B with the cable hanger disposed in the hanger landing and seal assembly.
Figure 5B:
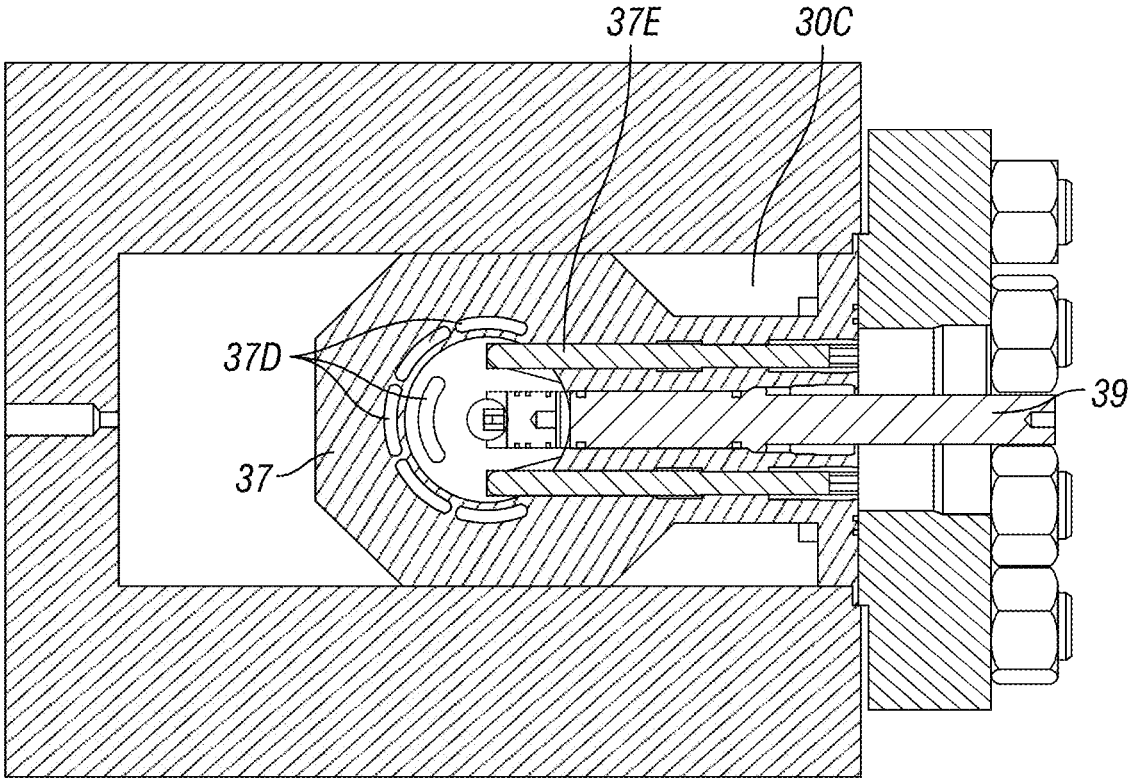

With the cable hanger 50 connected to the deployment cable 60, and now referring to FIGS. 5A and 5B, the running tool may be connected to the free, winch end of the deployment cable 60, or another cable, wireline or slickline, after the foregoing is run through the cable packing (not shown) in the lubricator (82 in FIG. 2A). The lubricator (82 in FIG. 2A) may be lifted and suspended over the BOP (27 in FIG. 2), and the running tool (not shown) connected to the fishing neck 50A. Tension may be applied to the winch end of the deployment cable 60, or other cable, wireline or slickline, to lift the cable clamp (not shown) off the BOP (27 in FIG. 2). The cable clamp (not shown) may then be removed and the lubricator (82 in FIG. 2A) reconnected to the BOP (27 in FIG. 2). Cable rams in the BOP (27 in FIG. 2) may then be opened, and the running tool may be lowered until the ESP (86, 88 in FIG. 2A) lands in the packer and the cable hanger 50 is seated in the replacement gate block 37.

When the cable hanger 50 is seated in the replacement gate block 37, the cable hanger 50 may be oriented so that the lockdown profile (50C in FIG. 4A) enables insertion of lockdown screws 37E through corresponding openings in the replacement gate block 37. As explained above with reference to FIGS. 4A and 4B, because the larger diameter portion (51A in FIG. 5A) is sealingly engaged to the central bore (37C in FIG. 3A) above and below the lockdown profile (50C in FIG. 5A), bores through the replacement gate block 37 for the lockdown screws 37E are not open to well fluid pressure and may be accessed from outside the master valve body 30A. The lockdown screws 37E may comprise a packing gland which provides a barrier to the escape of wellbore fluid in the event that the lockdown screws 37E are exposed to wellbore fluid.

FIG. 5B shows fluid flow passages or bypass flow ports 37D through the replacement gate block 37 to enable well fluid to move from below the master valve body 30A to above the master valve body 30A, while preventing flow through the side bore 30C.

Figure 6:
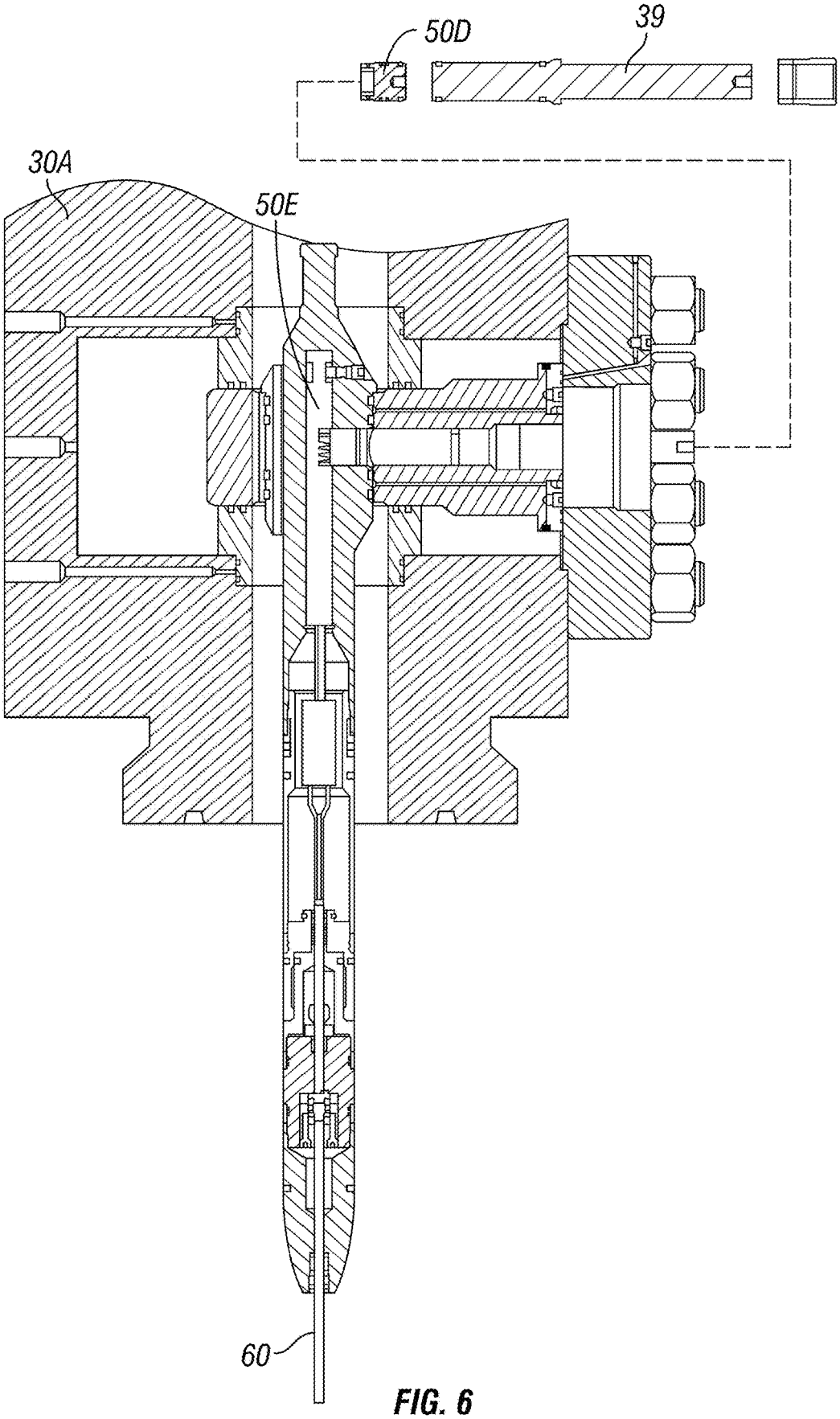
FIG. 6 shows a cross section view as in FIG. 5 wherein the horizontal blanking plug and running blanking plug have been removed.
Figure 7:
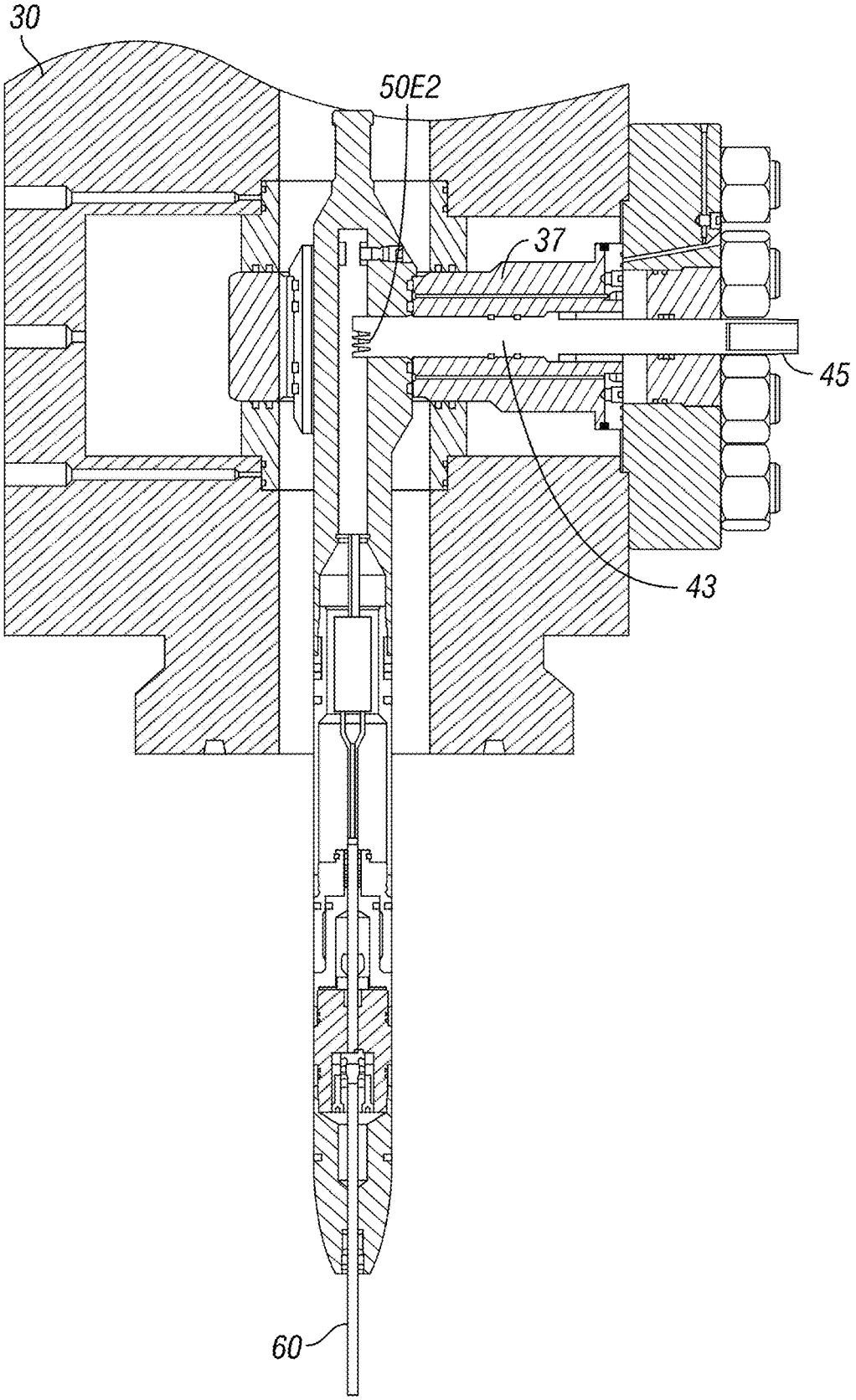
FIG. 7 shows a side penetrator and surface pigtail connector inserted into the vertical penetrator to complete installation of the ESP.

FIG. 6 shows the next action in an example of the method, which is to remove the horizontal blanking plug 39 from the replacement gate block 37 and to remove the blanking plug 50D from the vertical penetrator 50E. In FIG. 7, a horizontal penetrator 43, with an electrical pigtail connector 45 at one end and mating electrical contacts 50E2 at the other end, may be inserted into the replacement gate block 37. The mating electrical contacts 50E2 make electrical contact with the electrical contacts (50E1 in FIG. 4B) in the vertical penetrator (50E in FIG. 4B). Electrical connection to a surface power and control unit (not shown) may then be made to the electrical pigtail connector 45 to enable start-up and operation of the ESP (86, 88 in FIG. 2A) as would be done ordinarily.

Figure 8:
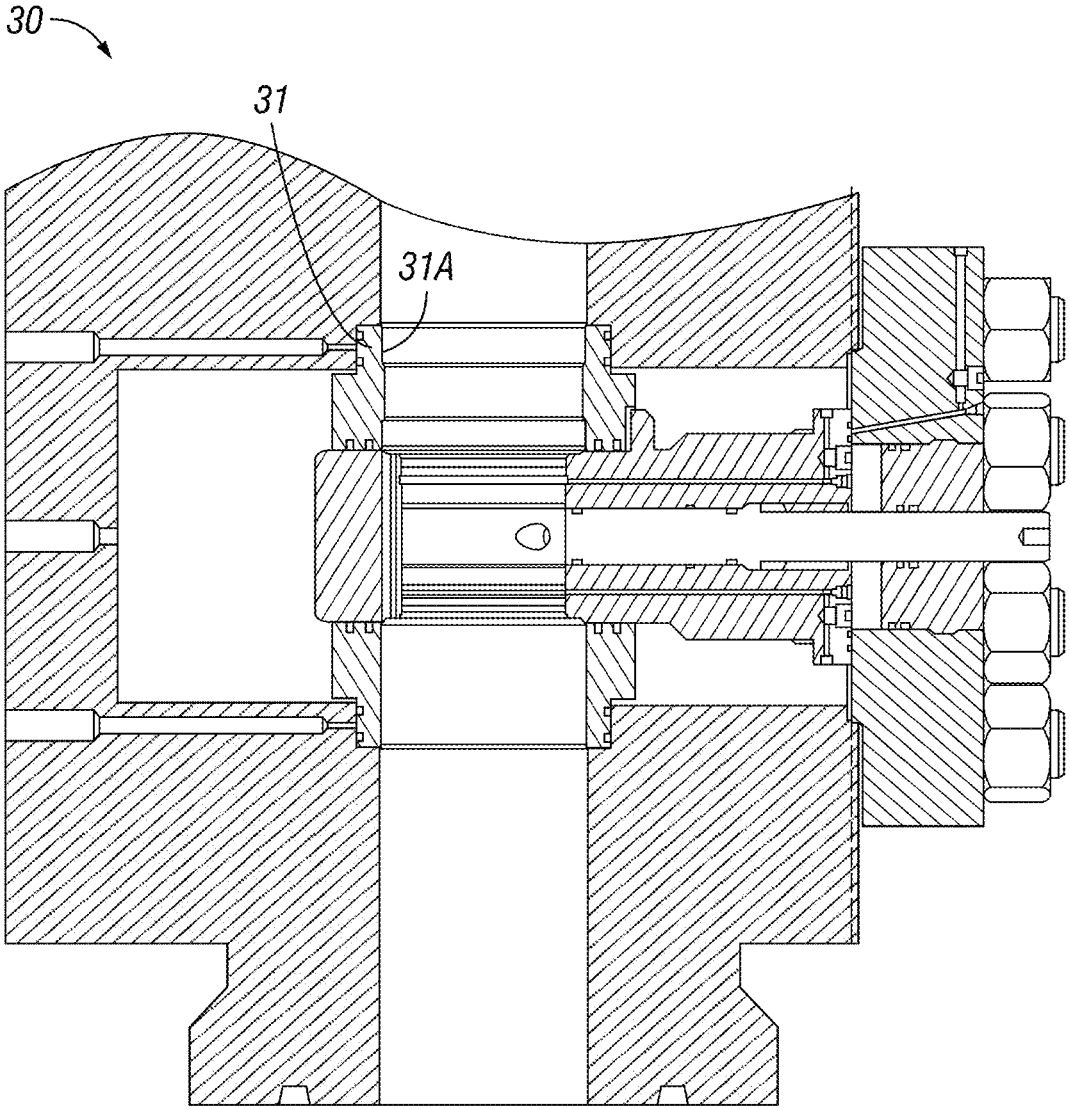
FIG. 8 shows another example of the lower master valve body and replacement components as in FIG. 3A, with the addition of a profile to affix a valve or plug in an upper gate seat.

In some circumstances, it may be advantageous to provide capability of inserting and affixing a plug above the lower master valve body (30A in FIG. 3A), for example, to repair the upper master valve (28 in FIG. 2). Referring to FIG. 8, in some examples, a profile 131 may be formed in the upper gate seat 31A. The profile [31A] 131 may be, for example, threads, a J-slot or any similar connecting feature to enable running and latching a device in the upper gate seat 31A. Such devices will be further explained with reference to FIGS. 10 and 11. With a suitable device such as a plug or back pressure valve disposed sealingly in the upper gate seat 31A, the well below the plug or back pressure valve will be closed to fluid flow. It may then be possible to service, repair or replace the upper master valve (28 in FIG. 2). After such service, the plug or back pressure valve may be removed.

Figure 9:
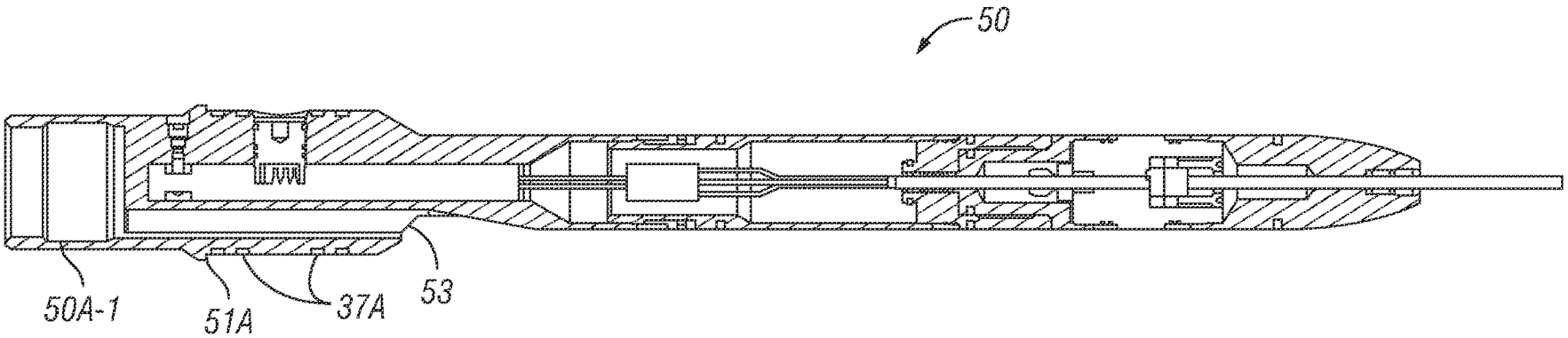
FIG. 9 shows another example of a cable hanger.

FIG. 9 shows another cable hanger 50, further comprising a flow port 53 formed along the length of the larger diameter section 51A, radially inward of the outer surface of the larger diameter section 51A, and exiting the larger diameter section 51A longitudinally outboard of the hanger seals 37A. The flow port 53 thus provides a passage to fluid flow from below the cable hanger 50 to above the cable hanger 50 within the lower master valve body (30A in FIG. 3A), but closes the horizontal bore (37B in FIG. 3A) in the replacement gate block (37 in FIG. 3A) to fluid flow when the cable hanger 50 is seated in the replacement gate block 37. The cable hanger 50 shown in FIG. 9 may have an internal profile 50A-1 at its upper end instead of a fishing neck as shown in FIG. 4A. The internal profile 50A-1 may be used to run the cable hanger 50. The internal profile 50A-1, and thus the lack of a fishing neck, may facilitate use of a back pressure valve in some instances, as will be further explained with reference to FIG. 11.

Figure 10:
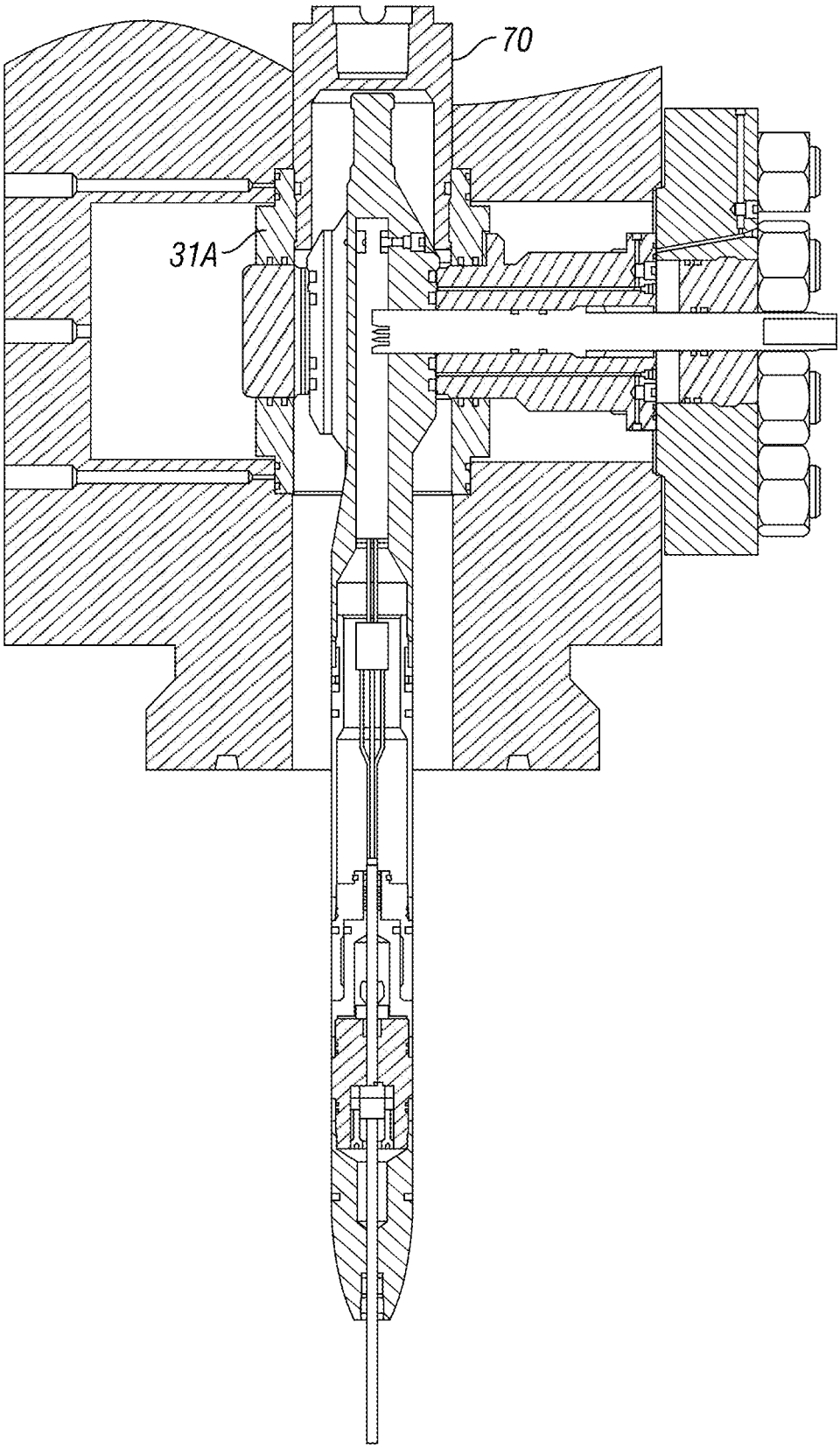
FIG. 10 shows a blanking plug affixed to the upper gate seat in the master valve body of FIG. 8.
Figure 11:
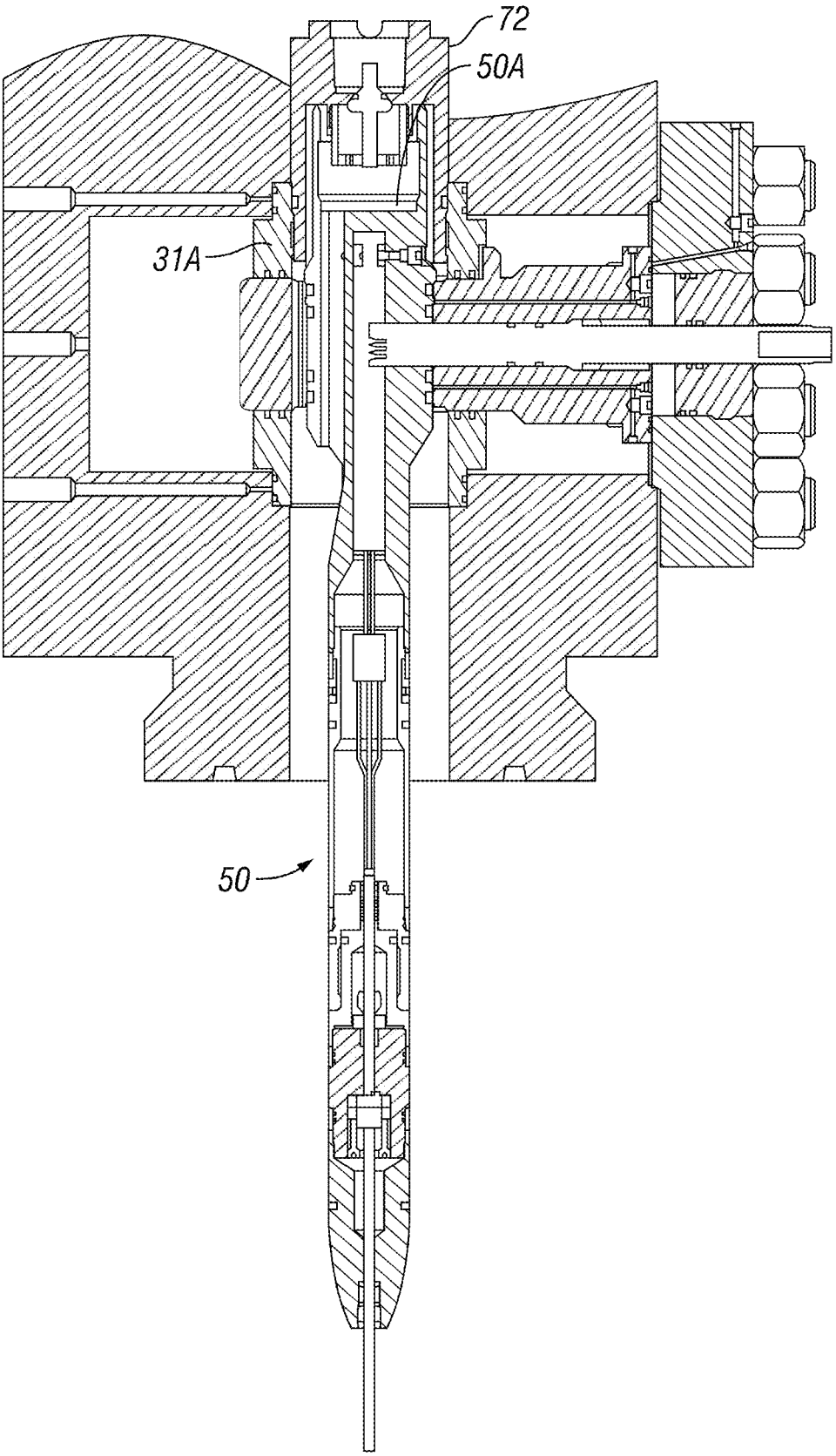
FIG. 11 shows a back pressure valve affixed to the upper gate seat instead of the blanking plug of FIG. 10, and another example of the cable hanger to reduce required axial length of the modified master valve.

FIG. 10 shows a blanking plug 70 affixed to the upper gate seat 31A. FIG. 11 shows a back pressure valve 72 affixed to the upper gate seat 31A. In examples using a back pressure valve, the cable hanger 50 may omit the fishing neck (50A in FIG. 4A) to reduce the overall axial dimension of the components in the lower master valve body (30A in FIG. 3A). Thus it may be possible to service and use the upper master valve (28 in FIG. 2) in such circumstances.

Figure 12:
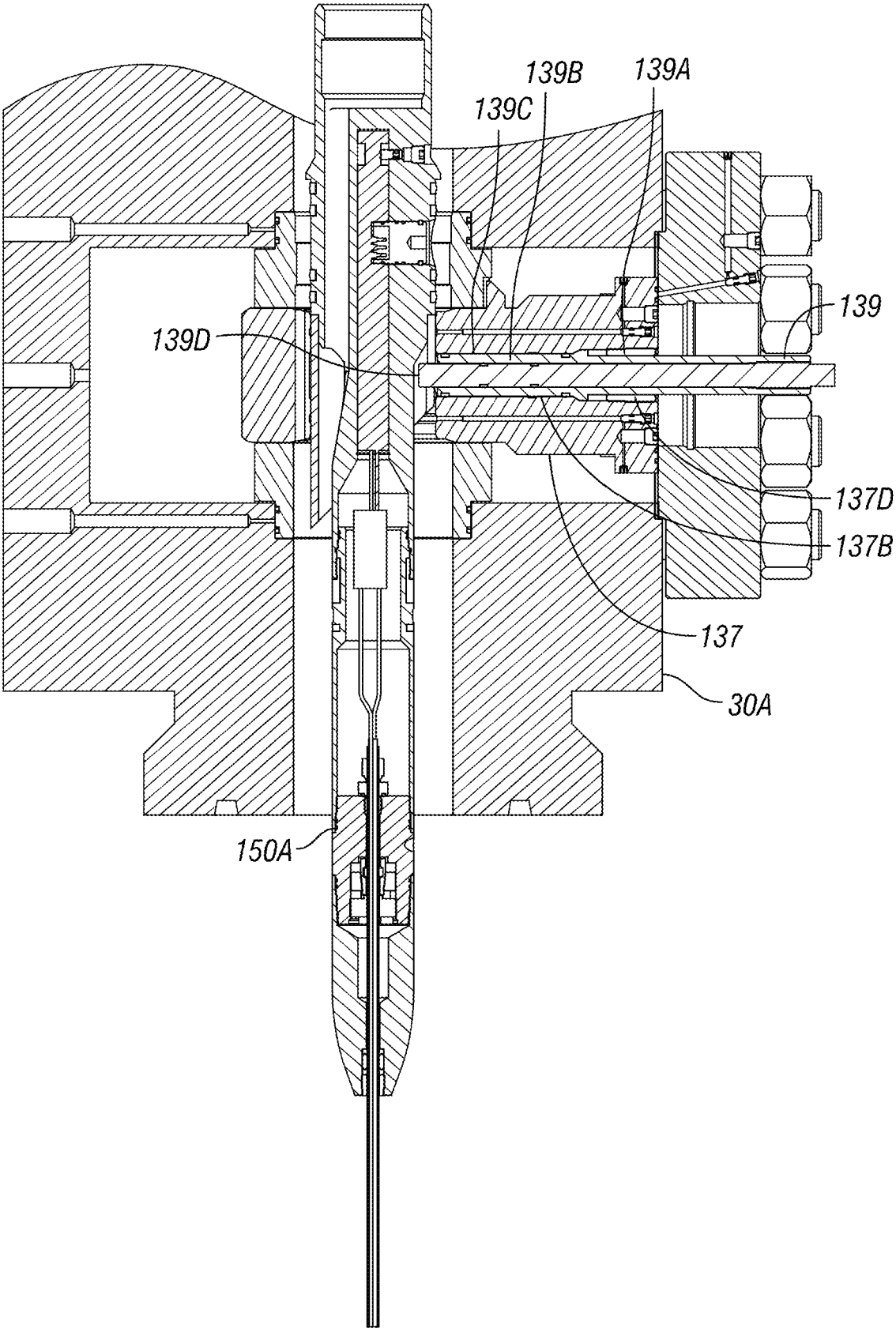
FIGS. 12 and 13 show various views of the lower master valve having an orientation screw or plug that may be used in some described examples.
Figure 13:
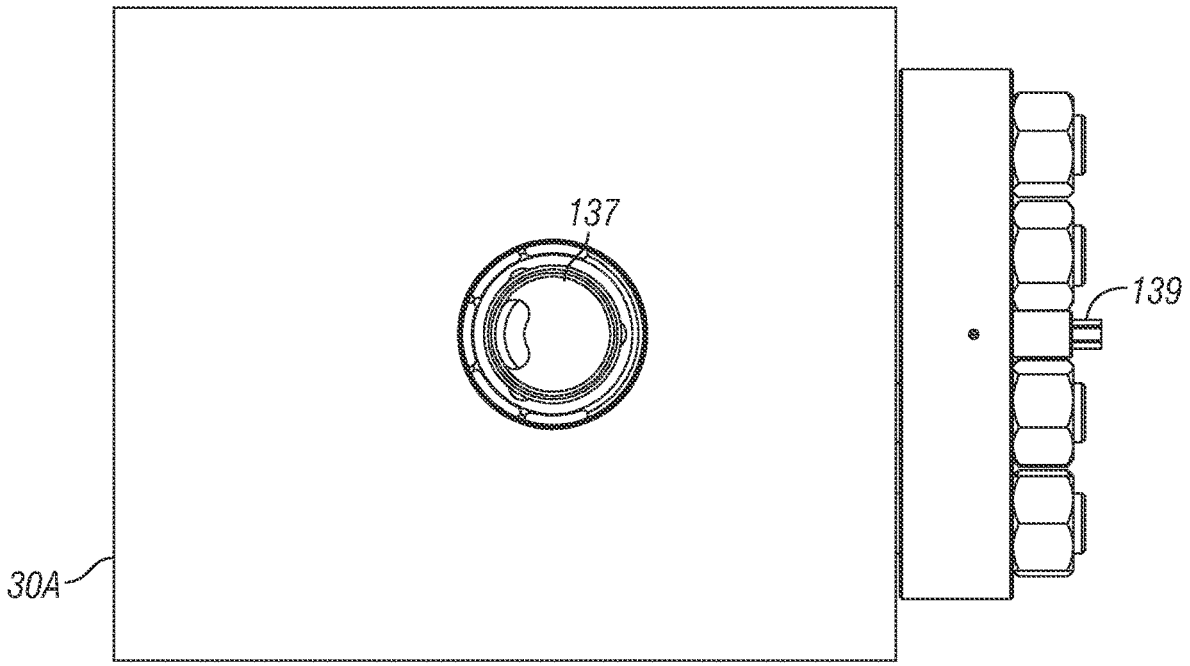

Some examples may include features to help orient the cable hanger as it is lowered into the lower master valve (30 in FIGS. 1A and 1B) as explained with reference to other examples. FIG. 12 shows a cross section view in the vertical plane, and FIG. 13 shows a corresponding top view of the valve body 30A, modified as explained with reference to FIGS. 3A and 3B, wherein a replacement gate block 137 has been provided in substitution of the valve gate as previously explained. In FIG. 12, the horizontal blanking plug (shown at 39 in FIGS. 3A and 3B) may be substituted by a sealingly engaged orientation screw or plug 139. The orientation screw or plug 139 may have a smooth external surface portion 139B having one or more external seals 139C such as o-rings to sealing engage the side bore 137B in the replacement gate block 137. The orientation screw or plug 139 may comprised a threaded portion 139A to engage a correspondingly threaded portion of the side bore 137B. In this way, the orientation screw or plug 139 may be disposed in the side bore 137 during running the cable hanger (150 in FIGS. 14 and 15) and may be removed after the cable hanger is seated in the replacement gate block 137 for eventual insertion of the side penetrator (see 43 in FIG. 7). When fully inserted as shown in FIG. 12, a tip 139D of the orientation screw or plug 139 may extend into the center bore of the replacement gate block to engage orientation features on the cable hanger, as will be explained below with reference to FIGS. 14 and 15.

Figure 14:
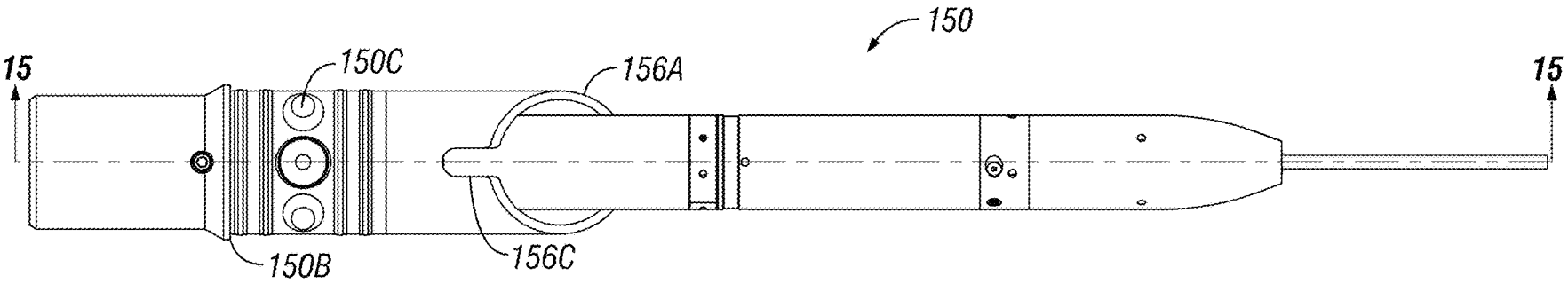
FIGS. 14 and 15 show various views of a cable hanger that may be used in some described examples.
Figure 15:
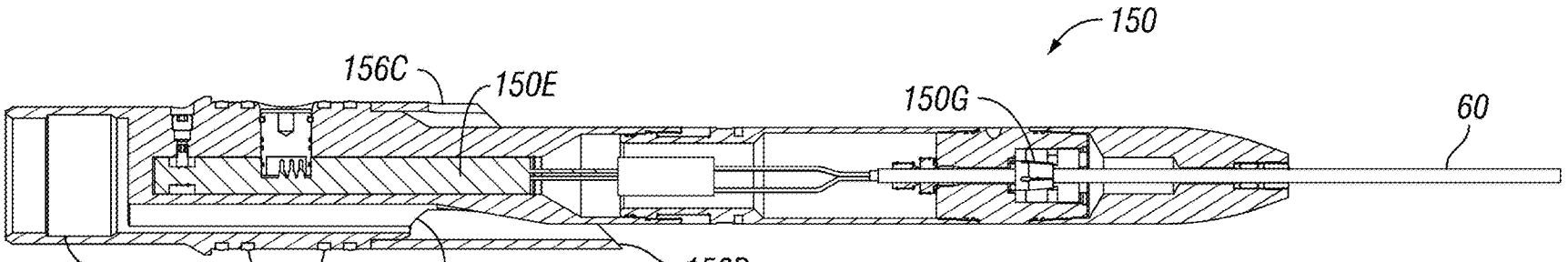

FIG. 14 shows a side view, and FIG. 15 shows a cross section view of a cable hanger 150 that may be used with the valve body and orientation plug or screw explained with reference to FIGS. 12 and 13. The cable hanger 150 may be similar in overall configuration to the example explained with reference to FIG. 9. The cable hanger 150 may comprise a landing "no-go" 150B, internal fishing profile 150A-1, lockdown profile 150C, fluid bypass porting 153, hanger seals 137A, cable slips 150G and vertical penetrator 150E as in other examples of the cable hanger described herein. The cable hanger 150 may comprise an orientation "tulip" 156A, which may be in the form of an annular cylinder projecting in the direction of the deployment cable 60 from below the hanger seals 137A, wherein a free end of the annular cylinder is cut at an oblique angle with reference to the longitudinal axis of the cable hanger 150. The resulting shape of the annular cylinder may be described as substantially helical, that is, its length is maximum on one side, shown at 156B, and shortens monotonically to being shortest on an opposed side. The shortest length may correspond to the circumferential or rotary position of an orientation slot 156C.

During the running procedure, as the cable hanger 150 is lowered into the valve body (30A in FIG. 12), the orientation tulip 156A will contact the orientation screw or plug (139 in FIG. 12) at the point on the orientation tulip 156A corresponding to the rotary orientation of the cable hanger 150. Because of the shape of the orientation tulip 156A, it will cooperate with the orientation screw or plug (139 in FIG. 12) to urge the cable hanger to rotate such that the orientation slot 156C becomes aligned with the orientation screw or plug (139 in FIG. 12). In this way, the cable hanger 150 will be at the correct rotary orientation for insertion of the lockdown screws as explained with reference to FIG. 5B. The remainder of the running procedure may be similar to that explained with reference to other embodiments in this disclosure.

A method according to the present disclosure may facilitate installing an ESP in a live well without the need to kill the well and while maintaining full pressure integrity. Further, in methods according to the present disclosure, it is not necessary to uncouple the tree from the well, to disassemble parts of the tree from each other or to move ancillary equipment such as flow lines, where such moving can be difficult and expensive. While the above description was made with reference to a flange connected tree as in FIG. 1A, descriptions of actions performed on and of components installed in the lower master valve are equally applicable to a monoblock tree as shown in FIG. 1B, and the scope of the present disclosure is accordingly not limited to the type of tree.

In light of the principles and examples described and illustrated herein, it will be recognized that the examples can be modified in arrangement and detail without departing from such principles. Accordingly, all such modifications are intended to be included within the scope of this disclosure as defined in the following claims. The foregoing discussion has focused on specific examples, but other configurations are also contemplated. In particular, if expressions such as in "an embodiment," or the like are used herein, these phrases are meant to generally reference embodiment possibilities, and are not intended to limit the disclosure to particular embodiment configurations. As used herein, these terms may reference the same or different embodiments or examples that are combinable into other embodiments or examples. As a rule, any embodiment or example referenced herein is freely combinable with any one or more of the other embodiments or examples referenced herein, and any number of features of different embodiments or examples are combinable with one another, unless indicated otherwise.

What is claimed is:

1. A method for installing an electric submersible pump (ESP) in a well, comprising:

installing at least one plug in the well below a well tree;

closing an upper master valve and a lower master valve in the well tree;

removing valve closure elements from the lower master valve and replacing the closure elements with gate seats and a replacement gate block, the replacement gate block comprising a seat for a cable hanger;

opening the upper master valve;

removing the at least one plug; and extending the ESP into the well on the end of an electrical cable; and affixing the cable hanger to the electrical cable and seating the cable hanger in the seat, the cable hanger comprising sealing elements to engage the seat and an electrical connector, the electrical connector oriented to enable access through a horizontal bore in the replacement gate block.

2. The method of claim 1, wherein the sealing elements on the cable hanger close the horizontal bore to fluid flow when the cable hanger is disposed in the seat.

3. The method of claim 1, wherein the installing the at least one plug, extending the ESP into the well and the affixing the cable hanger are performed after affixing a blowout preventer and a lubricator to the well tree after closing the upper master valve.

4. The method of claim 1, further comprising inserting a packer into the well after removing the at least one plug and prior to the extending of the ESP.

5. The method of claim 1, wherein the electrical cable comprises a tubing encapsulated cable.

6. The method of claim 1, further comprising making an electrical connection to the electrical connector and operating the ESP.

7. The method of claim 1, further comprising affixing at least one of a blanking plug or a back pressure valve in a profile in an upper one of the gate seats, the upper one of the gate seats disposed in a through bore in the lower master valve.

8. The method of claim 1, further comprising causing an orienting tool coupled to one end of the cable hanger to contact an orienting screw disposed in the horizontal bore, the orienting tool comprising at least one helically shaped orienting tulip to urge the cable hanger into a predetermined rotational orientation.

9. The method of claim 8, wherein the orienting screw extends into a through bore in the replacement gate block.

* * * * *